US011415398B2

(12) United States Patent
Blank

(10) Patent No.: US 11,415,398 B2
(45) Date of Patent: Aug. 16, 2022

(54) GAS FAVORING BOATTAIL PROJECTILE

(71) Applicant: US Strategic, LLC, St. Louis, MO (US)

(72) Inventor: Michael H. Blank, St. Louis, MO (US)

( * ) Notice: Subject to any disclaimer, the term of this patent is extended or adjusted under 35 U.S.C. 154(b) by 0 days.

(21) Appl. No.: 17/152,501

(22) Filed: Jan. 19, 2021

(65) Prior Publication Data

US 2021/0364260 A1 Nov. 25, 2021

Related U.S. Application Data

(60) Provisional application No. 62/963,062, filed on Jan. 19, 2020.

(51) Int. Cl.
*F42B 10/44* (2006.01)

(52) U.S. Cl.
CPC ..... *F42B 10/44* (2013.01)

(58) Field of Classification Search
CPC ..... F42B 10/44
USPC ..... 102/501
See application file for complete search history.

(56) References Cited

U.S. PATENT DOCUMENTS 5,847,313 A * 12/1998 Beal ..... F42B 12/74 102/516
10,830,564 B1 * 11/2020 Langenbeck ..... F42B 14/02
2020/0256656 A1 * 8/2020 Thielen ..... F42B 12/34

* cited by examiner

*Primary Examiner* — Samir Abdosh
(74) *Attorney, Agent, or Firm* — Charles McCloskey

(57) ABSTRACT

A gas favoring boattail projectile has a body, a nose extending from the body as an ogive, a tip upon the nose, a meplat of the tip, a frustum outwardly of the body and opposite the nose, and a base opposite the tip. The frustum also appears as a boattail and the body appears as a cylinder. The projectile has a caliber denoting its widest diameter and serving as the basis for additional dimensions measured from it. The meplat has a proportional relationship to the boattail and the boattail has an angular relationship to the surface of the cylinder. The relationships of specific features of the invention optimize its accuracy on target while remaining within weight and other specified parameters.

5 Claims, 2 Drawing Sheets

GAS FAVORING BOATTAIL PROJECTILE

CROSS-REFERENCE TO RELATED APPLICATION

This non-provisional application claims priority to the provisional application Ser. No. 62/963,062 filed on Jan. 19, 2020 and all applications have a common inventor.

BACKGROUND OF THE INVENTION

The present invention relates to ammunition in general and more particularly to shaping of a projectile for accuracy and aerodynamic performance.

In ancient days, man learned to throw rocks by hand against game or an enemy. Rocks had abundance depending upon geology and man had arms for propelling the rocks. Alas, rocks did fly through the air but air resistance limited their accuracy. Alas, man threw rocks but in short order, his arms would tire. In time, man being creative sought better ways to reach out and touch something or someone.

Man developed a rock secured to a straight shaft we know as a spear. Man threw the spear, the shaft guided it through the air, and the rock warhead connected with a target on impact. Man though had to carry the spear and numerous spears became heavy on long distances.

Then man realized, a spear could have a smaller size and developed the arrow and archery followed. Man had arrow shafts of various kinds tipped with arrow heads of a multitude of types. Arrowheads are still found of extreme age across the globe showing their prevalence through millennia.

As more centuries passed, man realized the technology of archery had other applications. Man merged archery with early engineering and made catapults. Catapults allowed man to launch heavy or dangerous objects great distances, to reach out and touch something or someone.

A few centuries later, the Chinese developed gunpowder and in time, it reached Western Europe. Before long, man realized gunpowder merged with aspects of archery, spears, and catapults yielded firearms. The first firearms appeared not much before Columbus sailed. The firearms had a marksman load gunpowder manually into a breech then place a wad into the muzzle and pack it towards the breech followed by a ball. The marksman, alone, in a hunting party, or in a military unit, then aimed his musket with the muzzle towards the target and fired it. The ball travelled as best it could, propelled by the gasses from the exploding gunpowder in the muzzle. Ah, the rock thrown by man of old now moves by operation of exploding gasses.

Thus over the last three centuries, firearms underwent a continuous evolution spurred by armed conflict from time to time, hunting regularly, and machine developments. Muzzle loaders became muskets. Muskets in time became rifles. Mortars became cannons. Cannons became artillery. All of these whether small or large moved a projectile at high velocities and improving accuracy. At higher velocities, projectiles endured aerodynamic forces during their flights to targets. Developments in machinery design allowed weapons to partially or fully mechanize insertion of projectiles into a breech, firing of the projectile, ejectment of spent material, and loading of the next projectile. As hunting made man a better marksman, armed combat made man's weapons and rifles more accurate. Nowadays, projectiles semi-automatic or automatic loading as they have the form of cartridges. Some weapons have become fully automatic and appear as machine guns. Yet each development in rifles and weapons still sought to move a projectile to reach out and touch something or someone at increasing distances. The ancient task of man remains.

DESCRIPTION OF THE PRIOR ART

Projectiles take many forms from large high explosive bombs, through missiles and rockets, to bullets of all kinds. Early bullets had the form of round lead balls made by soldiers in the fields of Europe, North America, and beyond. In the last century, bullets took on common forms as manufacturing standardized them. Many times ammunition manufacturers made both hunting cartridges and military cartridges. Each cartridge has a bullet place into one end of it upon the gunpowder and crimped. The bullet has its working end exposed for insertion into a breech and ultimate travel down a rifled barrel.

Present day bullets have a generally pointed tip upon a cylindrical body with sufficient weight, in grains, to survive detonation of the gunpowder, called primer, in the cartridge, of contact with gasses in the barrel, of flight through air, and of contact with a target or other item. Each phase of a bullet's life calls for precise shaping to meet the competing performance characteristics.

For example, Sierra Bullets, LLC of Sedalia, Mo. has a 308 bullet. This bullet has a pointed tip that widens in a conical section to a cylinder. The cylinder then tapers as a frustum, and the frustum truncates to a flat surface opposite the tip. The cylinder, frustum, or both also acquired the moniker boattail from aerodynamic effects observed in wind tunnel testing. Each portion of the bullet has its role to perform. And yet, this bullet still does not fully meet the demands of military, law enforcement, and hunters for accuracy.

Though preceding description has referred to bullets, the description also applies to artillery shells and other ordnance. While the above-described devices fulfill their respective, particular objectives and requirements, the aforementioned devices do not describe a gas favoring boattail projectile. Therefore, a need exists for new and improved gas favoring boattail projectile that can be used for improved release from a muzzle, flight performance, and shot grouping on a target. In this regard, the present invention substantially fulfills this need. In this respect, the gas favoring boattail projectile according to the present invention substantially departs from the conventional concepts and designs of the prior art, and in doing so provides a device primarily developed for the purpose of optimizing positive effects from the ogive and boattail of a projectile, primarily a bullet.

Also, in this specification where a feminine pronoun is used, the masculine pronoun is implied.

The gas favoring boattail projectile overcomes the above-mentioned disadvantages and drawbacks of the prior art. As such, the general purpose of the present invention, which will be described subsequently in greater detail, is to provide a new and improved gas favoring boattail projectile which has all the advantages of gas favoring boattail projectile which are not anticipated, rendered obvious, suggested, or even implied by the prior art, either alone or in any combination thereof.

SUMMARY OF THE INVENTION

The gas favoring boattail projectile has a body, a nose extending from the body as an ogive, a tip upon the nose, a meplat of the tip, a frustum outwardly of the body and opposite the nose, and a base opposite the tip. The frustum also appears as a boattail and the body appears as a cylinder. The projectile has a caliber denoting its widest diameter. The meplat has a proportional relationship to the boattail and the boattail has an angular relationship to the surface of the cylinder. The relationships of specific features of the invention optimize its accuracy on target while remaining within weight and other specified parameters.

There has thus been outlined, rather broadly, the more important features of the invention in order that the detailed description thereof that follows may be better understood and in order that the present contribution to the art may be better appreciated.

This invention also has proportions of its meplat to its length, relationships of boattail angle to base, proportions of base to overall length, and similarities in body length and boattail length though a projectile of the invention has various overall lengths. An alternate embodiment of the invention has a longitudinal conical aperture extending the length of the projectile. Additional features of the invention will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and devices for carrying out the several purposes of the present invention. It is important, therefore, that the claims be regarded as including such equivalent constructions insofar as they do not depart from the spirit and the scope of the present invention.

It is therefore an object of the present invention to provide a new and improved gas favoring boattail projectile that may be easily and efficiently manufactured and marketed to the consuming public and supply sources.

Still another object of the present invention is to provide a gas favoring boattail projectile that assists the projectile exiting a blast cloud upon firing.

Still another object of the present invention is to provide a gas favoring boattail projectile that coordinates its meplat with its ogive.

Still another object of the present invention is to provide a gas favoring boattail projectile that is propellant efficient.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
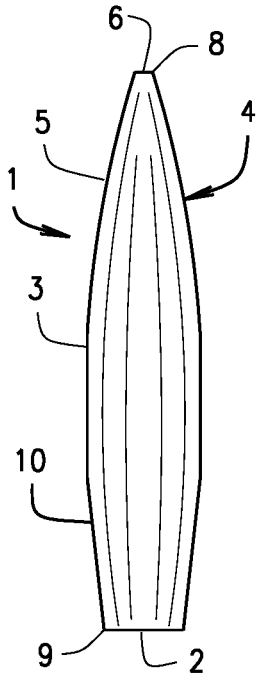
FIG. 1 is a side view of the preferred embodiment of the present invention.

Referring now to the drawings, and particularly to FIGS. 1-4, a preferred embodiment of the gas favoring boattail projectile of the present invention is shown by the reference numeral 1.

FIG. 1 shows a projectile 1 in a side view. Because this projectile is round, it is also symmetric from side to side. Thus FIG. 1 takes the place of other figures. Here, the projectile appears as a bullet though other forms are possible. The projectile has a generally elongated cylindrical form with a flat base 2 forming a plane perpendicular to the length of the invention. The projectile widens upwardly from the base through a frustum, also called a boattail 10, and has a frustoconical form, or shape. The base 2 joins to the boattail 10 of the frustum upon an aft edge 9. In the preferred embodiment, the aft edge 9 appears as a rim defined by the intersection of the plane of the base 2 to the frustoconical boattail 10. In an alternate embodiment, the aft edge 9 has a rounded rim decreasing formation of vortices and turbulent air flow rearward of the projectile.

The boattail widens and merges with the body 3, or cylinder, that also establishes the maximum diameter of the projectile, or its caliber. The body extends away from the boattail opposite the base. The body then merges into an ogive as at 4. The ogive has its form as a curve upon a radius greater than the length of the projectile and that curve is rotated about the centerline of the projectile. The ogive also provides a nose 5 of the projectile the decreases in its diameter as it departs the body. The decrease in diameter follows the curve established for the ogive and decreases more noticeably the further it gets away from the body. The nose narrows to its tip 6, opposite the base. The tip and the base define mutually parallel and spaced apart planes. The tip has a lesser diameter than that of the base and the caliber of the projectile. The tip also has a meplat form as later described. The tip 6 joins to the nose 5 of the ogive 4 upon a fore edge 8. In the preferred embodiment, the fore edge 8 appears as a rim defined by the intersection of the plane of the tip to the nose. In an alternate embodiment, the fore edge 8 has a rounded rim promoting initiation of laminar air flow at the nose and rearward along the projectile.

Upon experimentation and testing, the Applicant has found that while the ogive operates best with certain designs and projectile configurations, the key part of the invention relates to the area of the meplat. During testing, the Applicant endured breakage of equipment when making cartridges. In an alternate embodiment, the Applicant found semi-circular or, half moon, cuts of material out of the ogive kept close the accuracy of other projectiles. The Applicant identified that some previously pulled projectiles with partial deformation of their bases also had incredible inaccuracy. The Applicant's testing has yielded that almost without exception the inaccuracy of the projectile traces to damage upon the rear of the projectile. The Applicant strongly opines of this invention's significances for ordnance development, deserving of more attention from industry and its customers.

Figure 2:
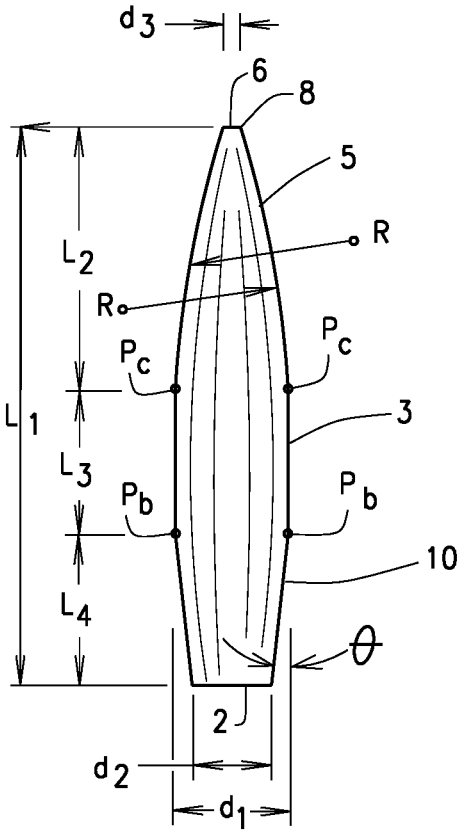
FIG. 2 is another side view of the invention denoting dimensional characteristics.

Turning to the key aspects of the invention, FIG. 2 shows a side view of the invention marked for dimensions, key points, and at least one angle. The invention has its maximum width, that is, maximum diameter, as at $d_1$, shown towards the bottom of the figure, typically towards the head of boattail 10. This maximum $d_1$ is the caliber of the projectile, alternatively $d_1$ is the first diameter. Inwardly from the maximum diameter, the boattail begins at its narrowest diameter as at $d_2$, also at the base 2, alternatively $d_2$ is the second diameter. Opposite the boattail and the base, the projectile has its narrowest diameter as at $d_3$ for the tip 6, alternatively $d_3$ is the third diameter. From the base to the tip, the projectile has its total length as at $L_1$, generally defined as a multiple of the caliber of the projectile, see Eq. 1. The total length has three components: second length as at $L_2$ from the nose, third length as at $L_3$ of the body, and the fourth length as at $L_4$ of the boattail. The length, second length, third length, and the fourth length extend generally parallel to the centerline of the projectile.

More particularly, the second length, $I_2$, is for the axial length of the nose from the tip 6 to where the ogive 4 ends, as at the fore edge 8. Here shown in a side view, the nose begins with the tip 6 and its truncated form, widens to the fore edge 8, and then follows the curve outwardly of the nose to the body 3. Where the curve of the nose approaches tangency to the body, the body commences as at $P_c$, the point of curvature. The third length, $L_3$, then shows the axial length of the body from the nose to the boattail. The third length extends from the point of curvature to a point of beginning as at $P_b$. The boattail then commences from the point of beginning. The point of curvature $P_c$ and the point of beginning $P_b$ appear shown in pairs to the left and to the right of the figure. These pairs have mutual spacing of the caliber of the projectile. The point of curvature $P_c$ and the point of beginning $P_b$ also have a spacing along the centerline of the projectile denoting the length of the body. The fourth length shows the distance along the centerline of the projectile over which the boattail tapers from the points of beginning $P_b$ to the base 2.

Moving from lengths, the boattail 10 has its truncated tapered shape from the base 2 with its narrowest diameter $d_2$ to the points of beginning $P_b$ spaced apart at the maximum diameter $d_1$ or caliber of the projectile. The difference between the maximum diameter $d_1$ and the narrowest diameter $d_2$ along the fourth length $L_4$ constitutes the boattail angle as at θ. The boattail angle, θ, tapers the boattail for fit into a cartridge, see Eq. 2, and later for passage of propellant gasses as the projectile exits a muzzle and through the atmosphere as the projectile travels to its target. Generally, opposite the boattail, the nose 5 may have its shape of an ogive 4. The ogive is a rotated conic section from a curve commencing at the points of curvature $P_c$ along a radius r on a center outwardly of the ogive. The curve terminates at the edge of the tip 6 as at the third diameter $d_3$.

$$\text{Thus where } \theta=7^\circ, \text{ then } l_4 \approx 1.2 * d_1 \qquad \text{Eq. 1}$$

$$3 < I_1 < 6 \qquad \text{Eq. 2}$$

Figure 3:
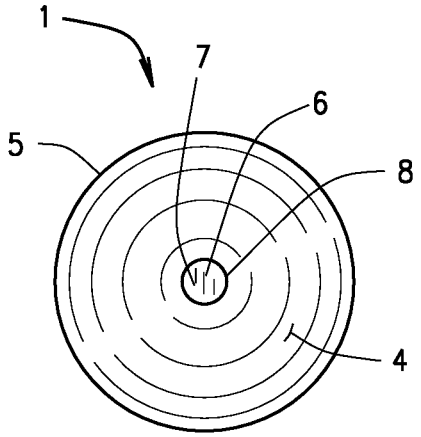
FIG. 3 is a front view of the invention.

FIG. 3 has the projectile of the invention shown in a front view as in the portion of the projectile that impacts a target first. The projectile has its nose 5 generally rounded in the ogive 4 from the widest portion, as at the first diameter $d_1$ or maximum, to the narrow portion, as at the tip 6. The widest portion is into the plane of this figure. The tip has the third diameter $d_3$ that defines the width of a meplat 7 which is a generally flat surface perpendicular to the length of the projectile. The meplat 7 extends inwardly from the fore edge 8 upon the tip 6. The tip and meplat also have form in coordination with the nose. The tip and meplat are out of the plane of this figure.

$$d_3 = \frac{n}{N} d_2, \qquad \text{Eq. 3}$$

where $0<n<0.33$ and $0<N<1.5$ $$d_3 = c d_2, \text{ where } 0.14 < c < 0.25 \qquad \text{Eq. 4}$$

The projectile has a critical part in the area of the meplat 7, that is, the flat area at the front of the projectile, such as a bullet, shown in FIG. 3 as at 7. More particularly in the preferred embodiment, the meplat has its diameter, or third diameter $d_3$, at the beginning of the projectile, between 0.010 and 0.015 times the diameter of the caliber. Opposite the meplat, the base 2 has its diameter $d_2$, the second diameter, as about as 0.70 times the caliber of the projectile, or $d_1$. Moreover, the base 2 has the diameter of the projectile's caliber reduced by about 0.15 times the diameter of the projectile per side, that is, about 0.30 divided by two, see Eq. 3, 4. Keeping in mind the boattail, the projectile of the invention has about a seven degree boattail angle, θ, that yields a boattail length $L_4$, or fourth length, of approximately 1.2 times the diameter of the caliber, see Eq. 1. This fourth length well exceeds lengths seen in industry at present. In an alternate embodiment, the tip 6, may have the form of a small hollow point as later shown in FIGS. 5-8.

Figure 4:
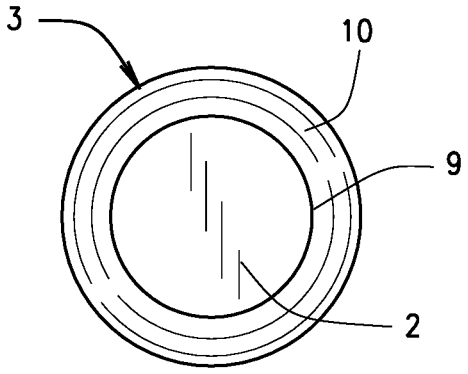
FIG. 4 is a rear view of the invention.

Turning the projectile once more, FIG. 4 shows a rear view of the projectile as seen before insertion into a cartridge, not shown, during manufacturing. The projectile has its body 3, generally round, of maximum diameter, as at $d_1$, and into the plane of this figure. The boattail 10 proceeds inwardly along the boattail angle, θ, to the aft edge 9 and then inwardly as the base 2. The base is centered upon the boattail and upon the projectile. The base extends out of the plane of this figure and has it narrow, or second, diameter $d_2$.

Returning to the boattail angle, θ, and its fourth length, both cooperate to define the form of the boattail 10. The boattail angle, θ, falls within a range of about 7 to about 10 degrees but the boattail leads to a much narrower base 2 than presently seen with its greater fourth length, that is, a longer tail. A boattail angle of 8.5 degrees stays proximate the caliber of the projectile which provides decent protection. In the prior art, a projectile has a rebated boattail that has a shoulder incised inwardly from the base, akin to a step, and the boattail commences at the shoulder. The present invention though has a proportional lengthening at the base, measured from the base and thus more narrow than the prior art. Thus, the present invention utilizes a boattail angle, θ, of about 7 to about 10 degrees. At the high end of that range, the invention still has a fourth length about 0.85 times caliber that exceeds prior art boattail lengths.

The boattail dimensions cooperate in this relationship:

$$\theta = \arctan\frac{d_1 - d_2}{Nd_1}, \quad \text{Eq. 5}$$

where 0<N<1.5

Turning to other ratios, the first length $L_1$ is:

$$L_1 = d_1 * N, \text{ where } N \text{ is an integer above 3.} \quad \text{Eq. 6}$$

The boattail 10 has these equations driving its dimensions:

$$L_2(cal) = d_1 * L_2; \quad \text{Eq. 7}$$

Per caliber and per side length given as $L_3$;

$$\text{angular base width reduction} = d_1 - 2*(d_3 * L_2 * L_3); \quad \text{Eq. 8}$$

$$\text{meplat width as } d_2 * N, 0 < N < 0.95; \quad \text{Eq. 9}$$

$$\text{nose length } L_2 \text{ as } d_1 * N, \text{ where } N \text{ is an integer above 2; and,} \quad \text{Eq. 10}$$

The ogive 4 follows the secant ¾ power law and has a ratio of $R_t/R$ of 0.5.

Let us turn to two examples. The first example is for a projectile having a first length, $L_1$, of four times caliber. The first length divides into the nose 5 having its second length, $L_2$, of two times caliber, the boattail having its fourth length, $L_4$, of 1.2217 caliber related from the boattail angle θ, and its body 3 having its third length $L_3$ as follows:

$$L_3 = L_1 - (N * d_1) - L_2, \text{ where } N \text{ is an integer above 3.} \quad \text{Eq. 11}$$

For the second example, a projectile has a first length, $L_1$ of five times caliber. The nose 5 then has its second length $I_2$ of two calibers, the boattail still has its fourth length, $L_4$ of 1.2217 caliber, and the body 3 following Eq. 11 has its third length $L_3$ as 0.7783 the same as the first example above.

Figure 5:
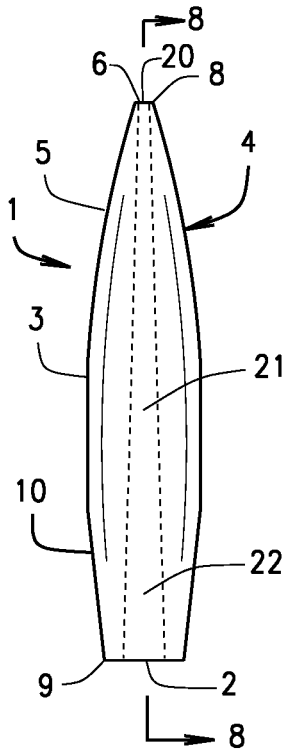
FIG. 5 is a side view of an alternate embodiment of the present invention.

FIG. 5 provides an alternate embodiment of a projectile 1 in a side view. Because this projectile is round, it is also symmetric from side to side. Thus FIG. 5 takes the place of other figures. Here, the projectile appears as a bullet though other forms are possible. As before, the projectile has a generally elongated cylindrical form with its flat base 2 from which it widens upwardly through a frustum, also called a boattail 10. The base 2 joins to the boattail 10 of the frustum upon the aft edge 9. The aft edge 9 appears as a rim defined by the intersection of the plane of the base 2 to the boattail 10 or alternately as a rounded rim.

The boattail widens and merges with the body 3 that sets the maximum diameter, or caliber, of the projectile. The body extends away from the boattail opposite the base. The body then merges into the ogive 4 with its form as a curve upon a radius greater than the length of the projectile and that curve being rotated about the centerline of the projectile. The ogive also has the nose 5 where the projectile decreases its diameter as it departs the body. The decrease in diameter follows the curve established for the ogive and decreases more noticeably the further it gets away from the body. The nose narrows to its tip 6, opposite the base. The tip and the base define mutually parallel and spaced apart planes. The tip has a lesser diameter than that of the base and the caliber of the projectile. The tip also has the meplat 7. The tip 6 joins to the nose 5 of the ogive 4 upon a fore edge 8. As before, the fore edge 8 appears as a rim defined by the intersection of the plane of the tip to the nose. The fore edge 8 has a rounded rim promoting initiation of laminar air flow at the nose and rearward along the projectile.

This alternate embodiment has an aperture 21, here shown in phantom, extending through its length. The aperture has its fore opening 20 within the tip 6 and an opposite aft opening 22 within the base 2. The fore opening generally has a round shape and a diameter while the aft opening has its round shape a diameter exceeding that of the fore opening. The aperture as it extends from the fore opening to the aft opening attains a tapered form widening opposite the direction of flight of the projectile. The tapered form of the aperture, particularly the aft opening leads to release and dissipation of any vacuum trailing the projectile thus reducing its drag. As later shown, the fore opening 20 and the aft opening 22 have a chamfer of approximately 0.5 r.

As to reducing vacuum, the present invention in its preferred embodiment and alternate embodiment has a calculably high ballistic coefficient. Utilizing typical, standard calculators, the invention has a ballistic coefficient at least 20% higher than the prior art because the boattail has more length than the prior art which leads to a smaller base creating less drag. The alternate embodiment with its aperture allowing air to pass into the vacuum behind the projectile would lessen the drag. This further drag reduction appears as observed evidence from tests and anecdotal evidence from tracer rounds that release a gas into the trailing vacuum. The tracer rounds unintentionally, and alas detrimentally, make their ballistic coefficient higher thus the tracer rounds really do not follow compatible flight tracks with the non-tracer projectiles. At the range, the Applicant has observed this where an observer sees tracer rounds flying over a berm and going on either side of targets, but does not see the targets falling. Meanwhile, experience and ballistics of non-tracer rounds suggest 5 to 10 projectiles should have impacted the targets, as 5 to 10 non-tracer rounds fly between consecutive tracer rounds. This failure to hit the targets occurs because the higher drag of the tracers has pulled their trajectory down and the tracer and non-tracer rounds impact the bottom of the berm and not the targets.

Figure 6:
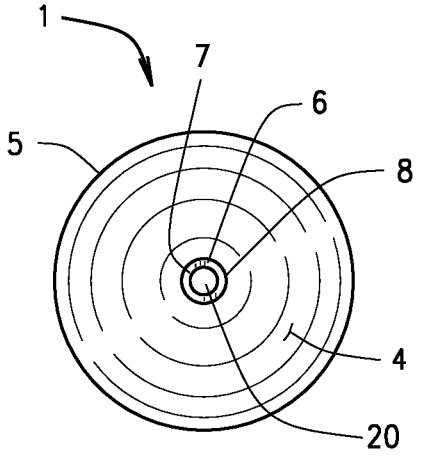
FIG. 6 is a front view of an alternate embodiment of the invention.

FIG. 6 then shows the alternate embodiment of the projectile of the invention shown in a front view with the fore opening 20 centered in the meplat 7 of the tip 6. As before, the projectile has its nose 5 generally rounded in the ogive 4 from the widest portion, as at the first diameter $d_1$ or maximum, to the narrow portion, as at the tip 6. The aperture 21 extends into the plane of this figure inwardly from the fore opening. The tip's widest portion is into the plane of this figure and it has the third diameter $d_3$ that defines the width of the meplat 7. The meplat follows Eq. 3, 4 as previously discussed. The projectile has a critical part in the area of the meplat 7, that is, the flat area at the front of the projectile, such as a bullet here shown. The tip 6, more precisely the meplat 7, in this alternate embodiment has the form of a small hollow point.

Figure 7:
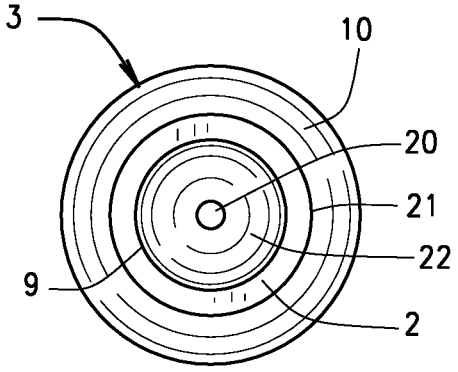
FIG. 7 is a rear view of an alternate embodiment of the invention.

Turning the projectile once more, FIG. 7 shows a rear view of the projectile as seen before insertion into a cartridge, not shown, during manufacturing. The projectile has its body 3, generally round, of maximum diameter, as at $d_1$, and into the plane of this figure. The boattail 10 proceeds inwardly along the boattail angle, θ, to the aft edge 9 and then inwardly as the base 2. The base is centered upon the boattail and upon the projectile. The base extends out of the plane of this figure and has it narrow, or second, diameter $d_2$. The base has the aft opening 22 centered upon it and leading into the aperture 21. The aft opening exceeds one quarter of the diameter of the base. From the aft opening to the fore opening, the aperture extends continuously. As before, the aft opening has a greater diameter than the fore opening, here shown well into the plane of the figure.

Figure 8:
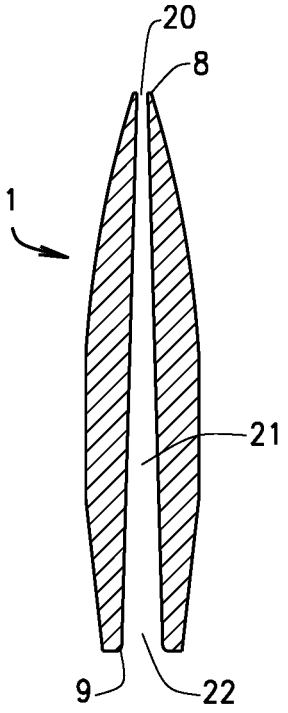
FIG. 8 is a section view of an alternate embodiment of the invention.

And FIG. 8 has a section view lengthwise through the alternate embodiment of the projectile. The projectile 1 has its lengthwise aperture 21 here shown in tapered form from the aft opening 22 to the fore opening 20. The two openings 20, 22 have rounded rims with a chamfer of approximately 0.5 r.

While a preferred embodiment of the gas favoring boattail projectile has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. The gas favoring boattail projectile may have metallic, alloy, polymer, or a composite material as its construction. For example, any suitable sturdy material such as brass for the body, steel for the base, and lead for the boattail may be used instead previously mentioned materials. The invention has a construction of a sturdy material that resists corrosion during lengthy storage periods and that survives initial impact on a target to penetrate it. Although providing a gas favoring boattail projectile, it should be appreciated that the gas favoring boattail projectile herein described is also suitable for bullets, artillery rounds, naval ordnance, line launching shots, avalanche mitigation efforts, and the like where a gas favoring boattail projectile has desirable application.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Various aspects of the illustrative embodiments have been described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations have been set forth in order to provide a thorough understanding of the illustrative embodiments. However, it will be apparent to one skilled in the art that the present invention may be practiced without the specific details. In other instances, well known features are omitted or simplified in order not to obscure the illustrative embodiments.

Various operations have been described as multiple discrete operations, in a manner that is most helpful in understanding the present invention, however, the order of description should not be construed as to imply that these operations are necessarily order dependent. In particular, these operations need not be performed in the order of presentation.

Moreover, in the specification and the following claims, the terms "first," "second," "third" and the like—when they appear—are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to ascertain the nature of the technical disclosure. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A gas favoring boattail projectile, comprising:

a nose having a tip and a second length;

a body extending coaxial from said nose opposite said tip and having a third length and a first diameter;

a boattail extending coaxial from said body and opposite said nose and having a fourth length and a boattail angle;

said projectile having a first length including said second length, said third length, and said fourth length;

said boattail having a base opposite said tip, said base having a second diameter less than said first diameter;

said tip having a third diameter less than said second diameter;

a meplat having a fore opening therein;

a base having an aft opening therein;

an aperture providing communication between said fore opening and said aft opening; and wherein a fluid entering said fore opening, passing through said aperture, and exiting said aft opening encounters no vacuum at said base.

2. The gas favoring boattail projectile of claim 1 further comprising:

said fore opening having a chamfer to said meplat and said aft opening having a chamfer to said base.

3. A gas favoring boattail projectile, comprising:

a nose, a body rearward of said nose, and a boattail rearward of said body;

said projectile having a first length including a second length, a third length, and a fourth length;

said nose having a tip and said second length;

said body extending coaxial from said nose opposite said tip, defining said third length, and having a first diameter; and, said boattail extending coaxial from said body and opposite said nose, having said fourth length, a base opposite said tip, and a boattail angle, said base having a second diameter less than said first diameter, and said boattail angle arising from the difference between said first diameter and said second diameter along said fourth length;

said tip having a third diameter less than said second diameter;

said tip having a meplat generally parallel to said base;

said meplat having a fore opening therein;

said base having an aft opening therein;

an aperture providing communication between said fore opening and said aft, opening; and wherein a fluid entering said fore opening, passing through said aperture, and exiting said aft opening encounters no vacuum at said base.

4. The gas favoring boattail projectile of claim 3 further comprising:

said fore opening having a chamfer to said meplat and said aft opening having a chamfer to said base.

5. A gas favoring boattail projectile, comprising:

a nose, a cylindrical body rearward of said nose, and a boattail rearward of said body;

said projectile having a first length including a second length, a third length, and a fourth length;

said nose having a tip and said second length, said tip having a meplat generally parallel to a base, said nose having an ogive form:

said body extending coaxial from said nose opposite said tip, defining said third length, and having a first diameter, said body spacing said tip outward from said body:

said boattail extending coaxial from said body and opposite said nose, having said fourth length, a base opposite said tip, and a boattail angle, said base having a second diameter less than said first diameter, said boattail being a frustum terminating in said base and tapering from said first diameter of said body to said second diameter of said base, and said boattail angle arising from the difference between said first diameter and said second diameter along said fourth length, said boattail angle being from 7 degrees to 10 degrees;

said tip having a third diameter less than said second diameter, the ogive form of said nose widening from said third diameter of said tip to said first diameter of said body:

said meplat having a third diameter of at least 0.01 of said first diameter;

wherein said first diameter exceeds said second diameter, said first diameter exceeds said third diameter, and said second diameter exceeds said third diameter, and wherein said second length exceeds said third length and said second length exceeds said fourth length;

said meplat having a fore opening therein;

said base having an aft opening therein;

an aperture providing communication between said fore opening and said aft opening;

said nose extending from said meplat to a point of curvature;

said body extending from the point of curvature to a point of beginning:

said boattail extending from the point of beginning to said base; and wherein a fluid entering said fore opening, passing through said aperture, and exiting said aft opening encounters no vacuum at said base.

* * * * *